US011472214B1

(12) United States Patent
Ambartsoumian

(10) Patent No.: US 11,472,214 B1
(45) Date of Patent: Oct. 18, 2022

(54) SHIELDED DIRECT THERMAL LABEL AND METHODS

(71) Applicant: Gourgen Ambartsoumian, Laval (CA)

(72) Inventor: Gourgen Ambartsoumian, Laval (CA)

( * ) Notice: Subject to any disclaimer, the term of this patent is extended or adjusted under 35 U.S.C. 154(b) by 171 days.

(21) Appl. No.: 16/217,885

(22) Filed: Dec. 12, 2018

Related U.S. Application Data

(60) Provisional application No. 62/597,665, filed on Dec. 12, 2017.

(51) Int. Cl.

| | |
|---|---|
| ***B41M 5/50*** | (2006.01) |
| ***B65C 9/46*** | (2006.01) |
| ***G09F 3/02*** | (2006.01) |
| ***B65C 3/06*** | (2006.01) |
| ***B41M 5/42*** | (2006.01) |

(52) U.S. Cl.
CPC ..... *B41M 5/502* (2013.01); *B41M 5/42* (2013.01); *B65C 3/06* (2013.01); *B65C 9/46* (2013.01); *G09F 3/02* (2013.01); *B41M 2205/40* (2013.01); *G09F 2003/023* (2013.01); *G09F 2003/0211* (2013.01); *G09F 2003/0257* (2013.01)

(58) Field of Classification Search
CPC .... B41M 5/502; B41M 5/42; B41M 2205/40; B41M 5/50–508; B41M 5/52–529; B41M 2205/04; B65C 3/06; B65C 9/46; G09F 2003/0211
USPC ..... 428/32.39–32.52, 32.6–32.87
See application file for complete search history.

(56) References Cited

U.S. PATENT DOCUMENTS 4,886,774 A * 12/1989 Doi ..... B41M 5/405 503/226
5,424,182 A * 6/1995 Marginean, Sr. ..... B41M 5/32 430/338
5,753,587 A * 5/1998 Podszun ..... G03C 1/4989 427/152
2004/0171485 A1* 9/2004 Nagai ..... B41M 5/465 503/201
2009/0249670 A1* 10/2009 Henkel ..... G09F 3/0288 40/675
2009/0286032 A1* 11/2009 Franklin ..... B32B 38/145 428/41.8

(Continued)

FOREIGN PATENT DOCUMENTS

WO WO-2016152088 A1 * 9/2016 ..... B41M 7/0009

OTHER PUBLICATIONS

High Purity 1-Hydroxycyclohexyl phenyl ketone via http://www.sellchems.com/products/uv-photoinitiators/cas-947-19-3/.*

(Continued)

*Primary Examiner* — Laura C Powers
(74) *Attorney, Agent, or Firm* — Norton Rose Fulbright Canada LLP

(57) ABSTRACT

A label comprises a facestock adapted to be adhered or attached to an object. A direct thermal coating is on the facestock, the direct thermal coating configured to selectively darken by heat activation when direct thermal printed. A cured ultraviolet coating is on the direct thermal coating, the cured ultraviolet coating having photoinitiators with substantial activation at an exposure limited to radiation at a 315 nm-450 nm wavelength range, and configured to allow direct thermal printing of the direct thermal coating therethrough. The ultraviolet coating is cured without heat activating the direct thermal coating.

20 Claims, 7 Drawing Sheets

(56) References Cited

U.S. PATENT DOCUMENTS

2016/0244250 A1* 8/2016 Dolan, Jr. ..... B65D 85/8043

OTHER PUBLICATIONS

1-Hydroxycyclohexyl Phenyl Ketone Boldchem Tech via https://www.boldchem.com/1-hydroxycyclohexyl-phenyl-ketone/#:~:text=1%2DHydroxycyclohexyl%20Phenyl%20Ketone%20is,is%20947%2D19%2D3.&text=Melting%20Point%3A%2047%2D50%20%C2%B0C(lit.)&text=Boiling%20Point%3A%20175%20%C2%B0C15%20mm%20Hg(lit.).*

Ingracure 184 CAs 947-19-3 via http://www.boldchem.com/chemicals/irgacure-184-cas-947-19-3/#:~:text=1%2DHydroxycyclohexyl%20phenyl%20ketone%20is,absorption%20wavelength%20is%20333%20nm.*

* cited by examiner

SHIELDED DIRECT THERMAL LABEL AND METHODS

CROSS-REFERENCE TO RELATED APPLICATION

The present application claims the priority of U.S. Provisional Patent Application No. 62/597,665, filed on Dec. 12, 2017, the contents of which are incorporated herein by reference.

TECHNICAL FIELD

The present application relates to direct thermal printing and labels.

BACKGROUND OF THE ART

Direct thermal printing involves the heating of selected areas or zones of a coating on a substrate in order to heat activate a dye by reaction with a matrix. According to FIGS. 1A-1B of the prior art, a typical direct thermal label 10 is shown as having a facestock 11, an adhesive 12 covering an undersurface of the facestock 11, an adhesive release layer 13, and a support liner 14, in one possible embodiment. The facestock 11 and adhesive 12 are united together and upon removal of the facestock 11 from the support liner 14, the adhesive 12 remains bonded to it. The removal of the facestock 11 from the support liner 14 may be facilitated by the adhesive release layer 13. The label 10 has a direct thermal coating 15, with dye and matrix. The print head A is controlled to heat the desired areas of the direct thermal and cause the reaction between dye and matrix, to blacken the areas. The blackened areas define the printing on the label 10.

Direct thermal printing is known to be cost effective, notably by not requiring a toner, a printer-applied ink or an inked ribbon in a printer, and thus printed by the relatively inexpensive printers used in direct thermal printing. However, areas printed with direct thermal may tend to fade over time, and may lack the capacity of resisting to liquids such as solvents and chemicals. It is known to apply an ultraviolet (UV) varnish over labels, but conventional wide-spectrum UV curing will heat the direct-thermal material and cause blackening and renders the use of the UV varnish impractical in some instances.

SUMMARY

It is an aim of the present disclosure to provide a label with UV coating that addresses issues related to the prior art.

It is a further aim of the present disclosure to provide a method for printing and protecting a direct thermal label with a LED UV coating.

Therefore, in accordance with the present disclosure, a label comprising: a facestock adapted to be adhered to an object; a direct thermal coating on the facestock, the direct thermal coating configured to selectively darken by heat activation when direct thermal printed; and a cured ultraviolet coating on the direct thermal coating, the cured ultraviolet coating having photoinitiators with substantial activation at an exposure limited to radiation at a 315 nm-450 nm wavelength range, and configured to allow direct thermal printing of the direct thermal coating therethrough, wherein the ultraviolet coating is cured without heat activating the direct thermal coating.

Further in accordance with the present disclosure, there is provided a label comprising: a facestock adapted to be adhered to an object; a direct thermal coating on the facestock, the direct thermal coating configured to selectively darken by heat activation when direct thermal printed; a cured ultraviolet coating on the direct thermal coating, the cured ultraviolet coating having photoinitiators activated to at least 75% with exposure limited to a 315 nm-450 nm wavelength range, and configured to allow direct thermal printing of the direct thermal coating therethrough, wherein the ultraviolet coating is cured without heat activating the direct thermal coating.

Further in accordance with the present disclosure, there is provided a method for fabricating a direct thermal label comprising: applying an ultraviolet coating on a direct thermal coating on a facestock; substantially curing the ultraviolet coating by exposure to ultraviolet light-emitting diodes producing light in a wavelength range of 315 nm-450 nm; and while substantially curing the ultraviolet coating, maintaining the direct thermal coating below a threshold temperature above which the direct thermal coating is activated.

Still further in accordance with the present disclosure, there is provided a method for using a direct thermal label comprising: obtaining a label with a direct thermal coating shielded by a cured ultraviolet coating; heat activating selected zones of the direct thermal coating through the ultraviolet coating to darken the selected zones; and adhering the label with the selected zones darkened to an object.

DETAILED DESCRIPTION

Figure 1B:
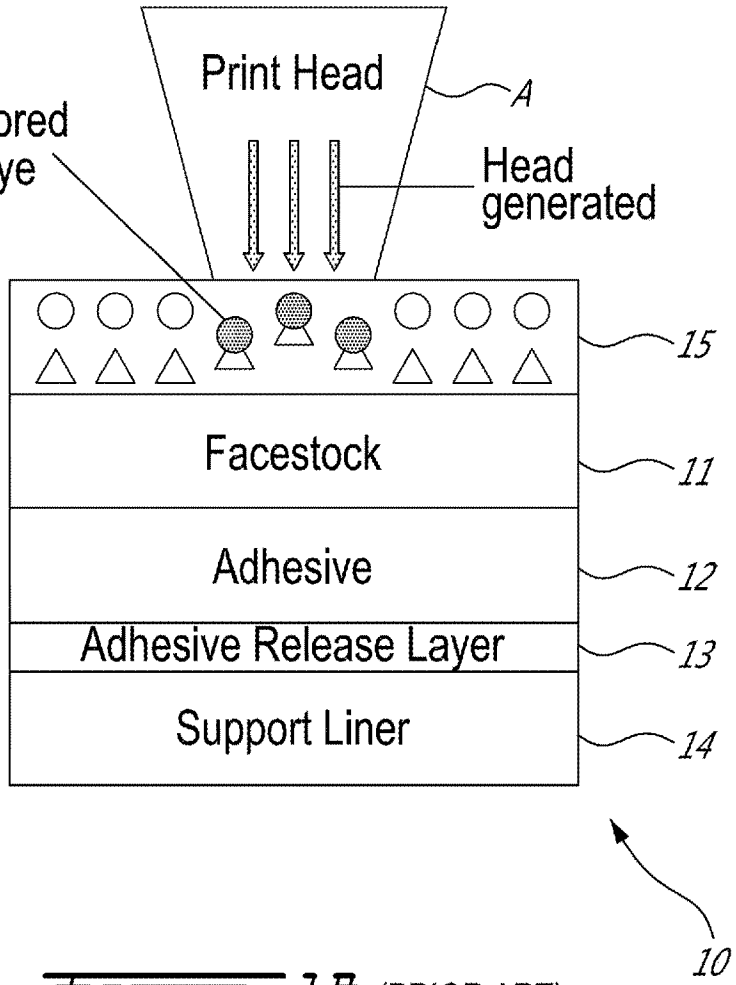
FIG. 1B (PRIOR ART)
FIGS. 1A and 1B are schematic views of a sequence of a direct thermal label prior to printing and followed by a printing thereof in accordance with the prior art.
Figure 1A:
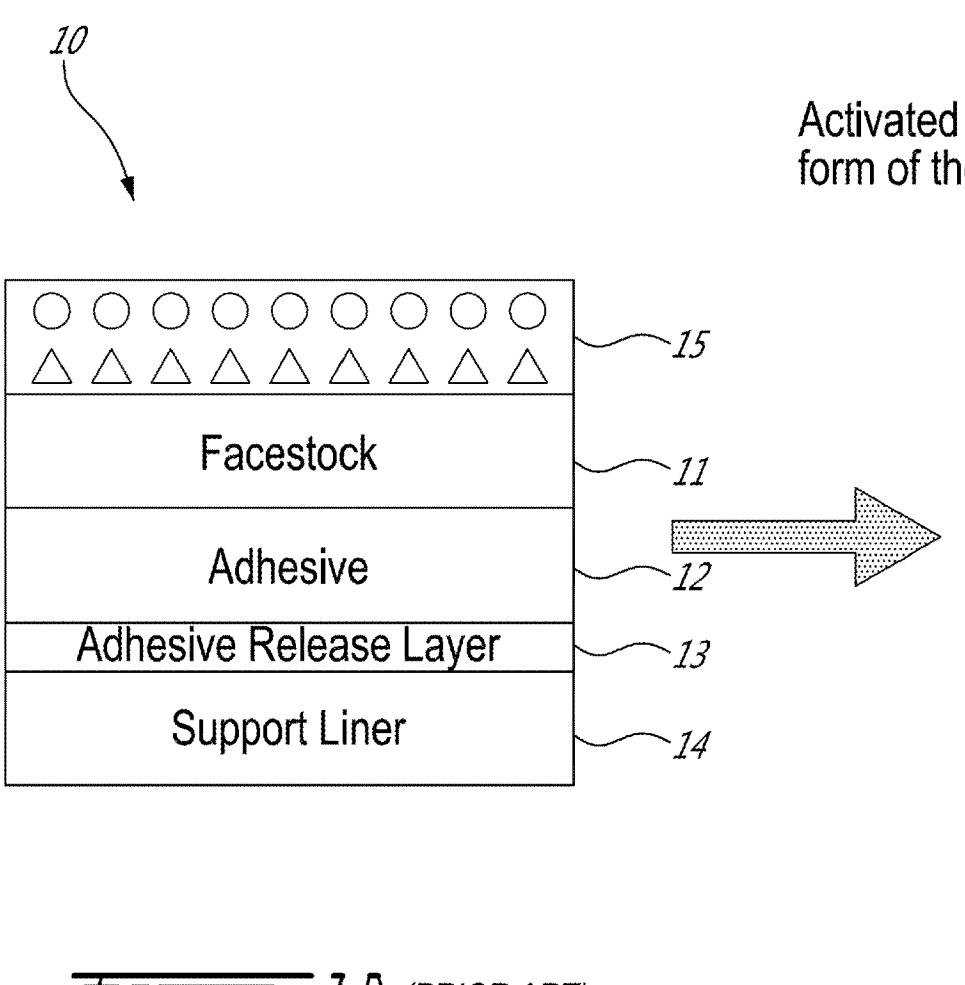
FIG. 1A (PRIOR ART)
Figure 2C:
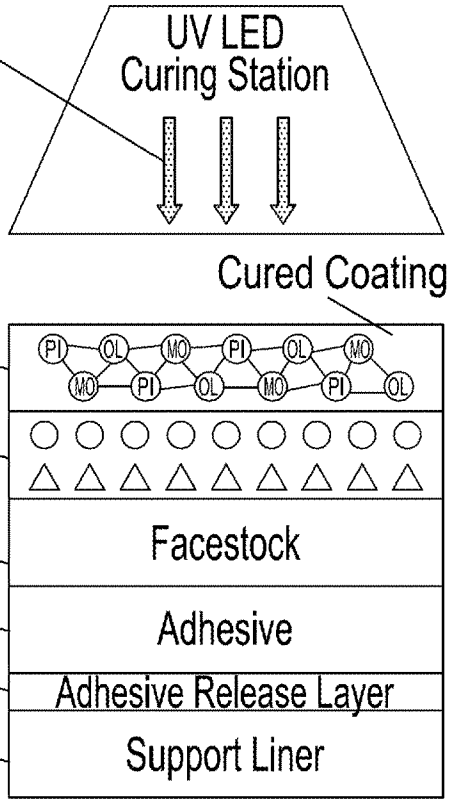
FIGS. 2A-2C are schematic views of sequence of a method of fabricating of a direct thermal label with LED UV coating in accordance with the present disclosure.
Figure 2B:
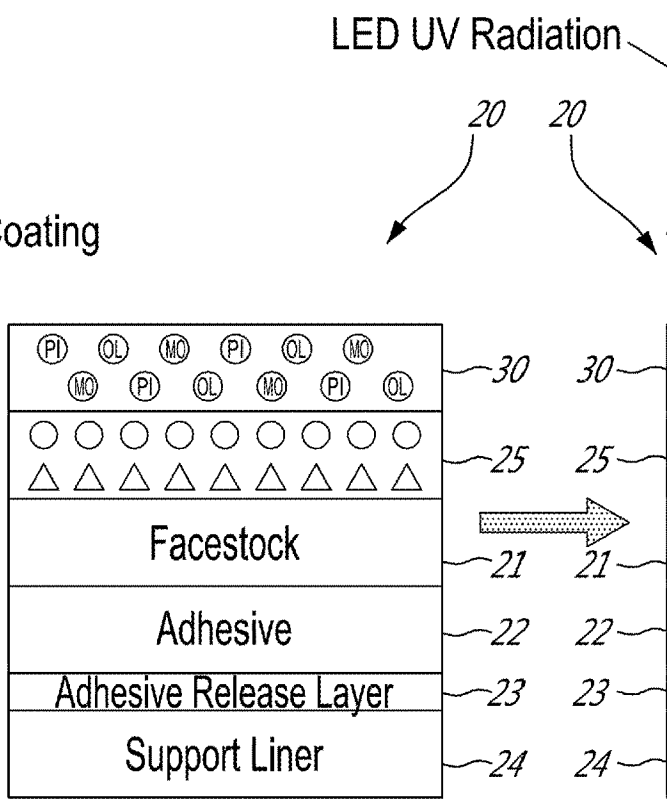
Figure 2A:
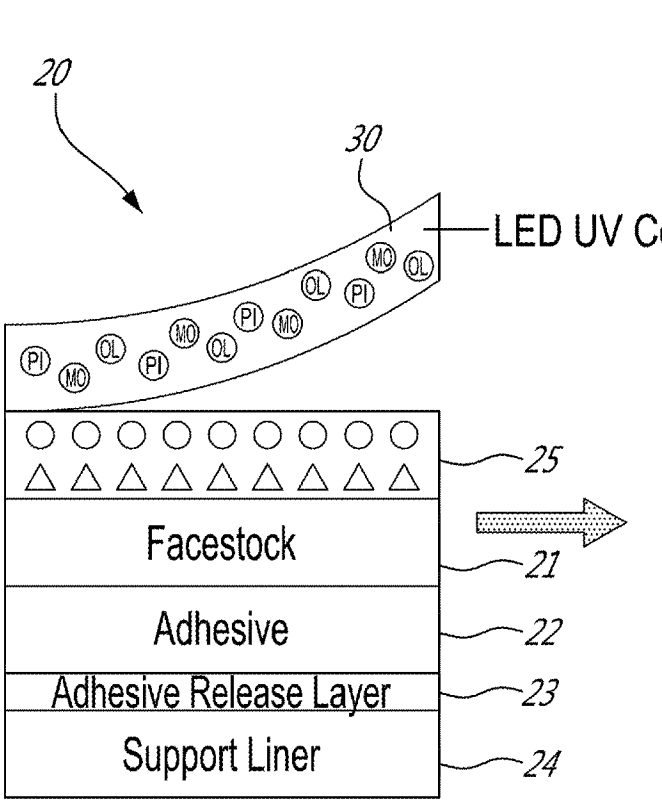

Referring to the drawings and more particularly to FIGS. 2A-2C, a direct thermal label with LED UV coating in accordance with the present disclosure is generally shown at 20. The label 20 may have a facestock 21, an adhesive 22 covering an undersurface of the facestock 21, an adhesive release layer 23, and/or a support liner 24, in one possible embodiment. For example, the label 20 may be without the adhesive release layer 23, and/or with the support liner 24 having a low adherence surface in contact with the adhesive 22. The facestock 21 and adhesive 22 may be pulled out of engagement with the support liner 24, for instance as assisted by the adhesive release layer 23 if present. The facestock 21 may then be adhered to an object by way of the adhesive 22. The facestock 21 may be made of any appropriate materials, such as paper or fiber-based materials, polymers, synthetic films, thermoplastic films such as polyolefins, polypropylenes, biaxially oriented polypropylene (BOPP), polyesters, polyvinyl, polyethylene, polystyrene and similar polymer based materials, etc. According to an embodiment, the facestock 21 has a thickness between 0.5 mil-10 mil, although it may also be thinner or thicker. The label material may include an ink layer over the facestock 21 and/or over direct thermal coating 25. In another embodiment, the facestock 21 and/or direct thermal coating 25 may comprise an additional layer of a topcoat. The facestock 21 of the material might be opaque or transparent, or have different degrees of opacity and transparency. Yet in another embodiment, the facestock 21 may be void of adhesive 22 and support liner 24, for the facestock 21 to be used as a non-adhesive material in a roll, sheet, tag or a fanfold format. The facestock 21 may be a static cling film on a support liner without an adhesive. The label 20 with such a facestock 21 may be attached to surfaces through static.

Figure 3B:
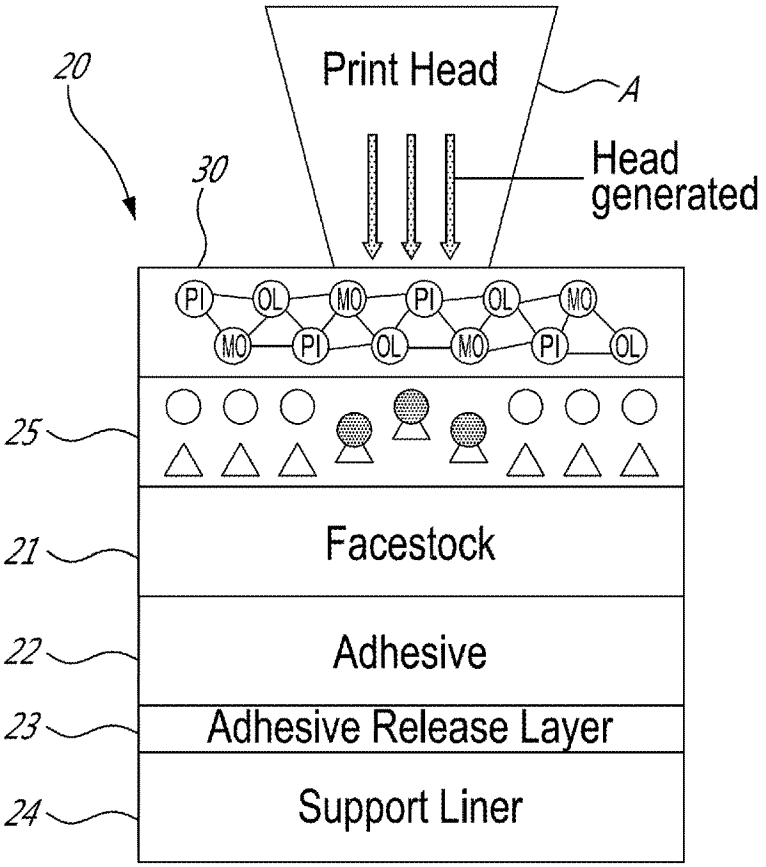
FIGS. 3A and 3B are schematic views of a method for printing the direct thermal label with UV coating of the present disclosure.
Figure 3A:
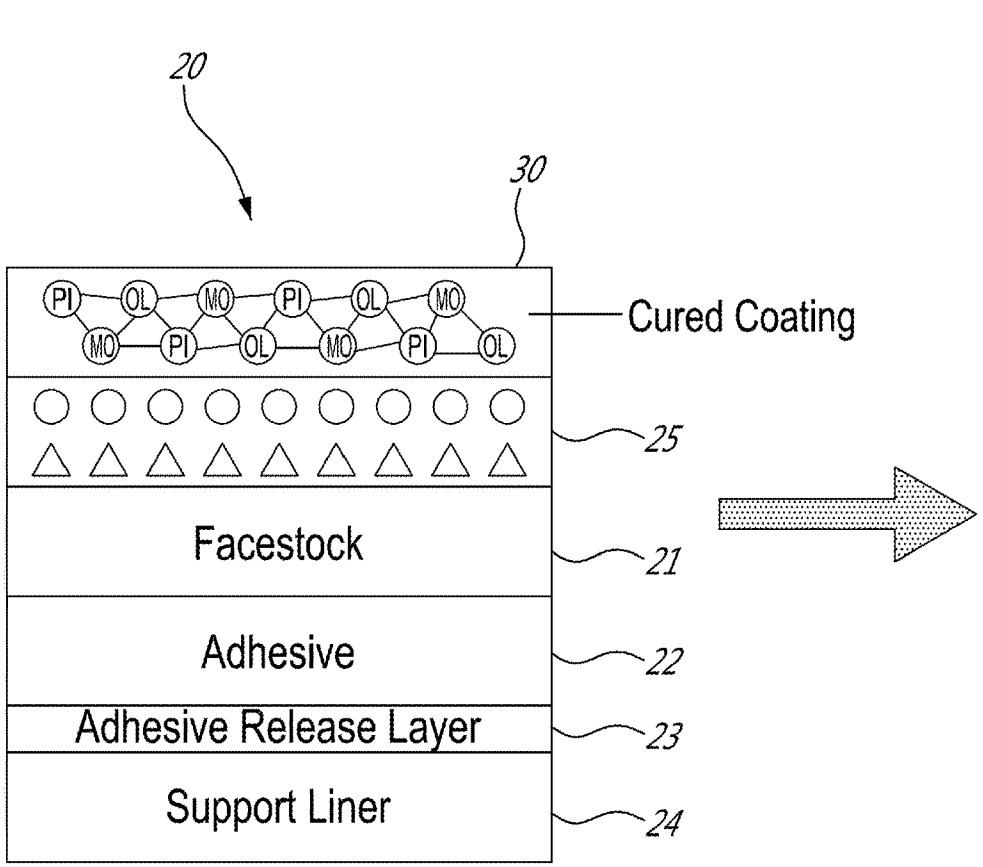
Figure 4A:
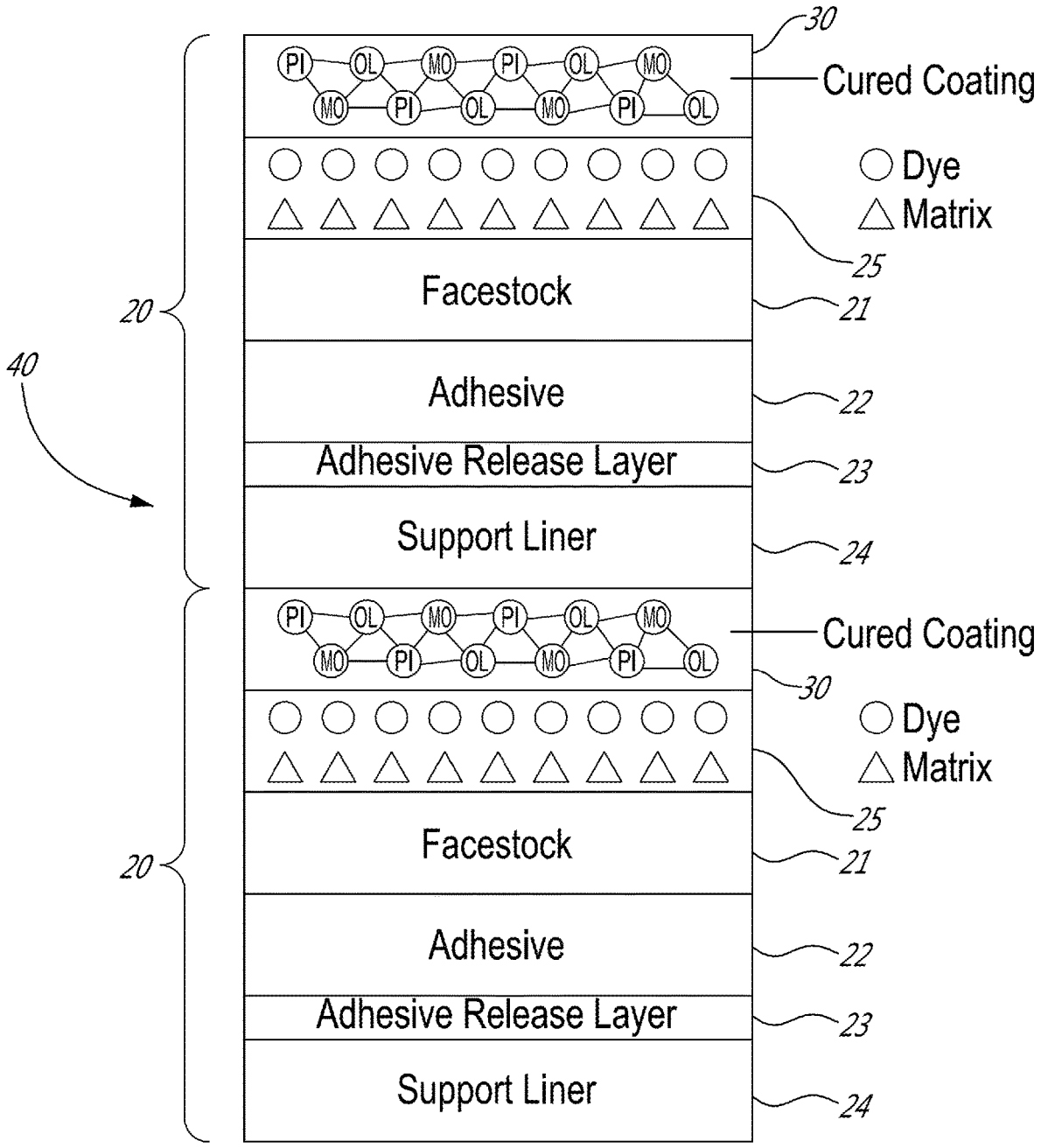
FIGS. 4A-4D are schematic views of various embodiments of the direct thermal label with LED UV coating, in a roll.
Figure 4B:
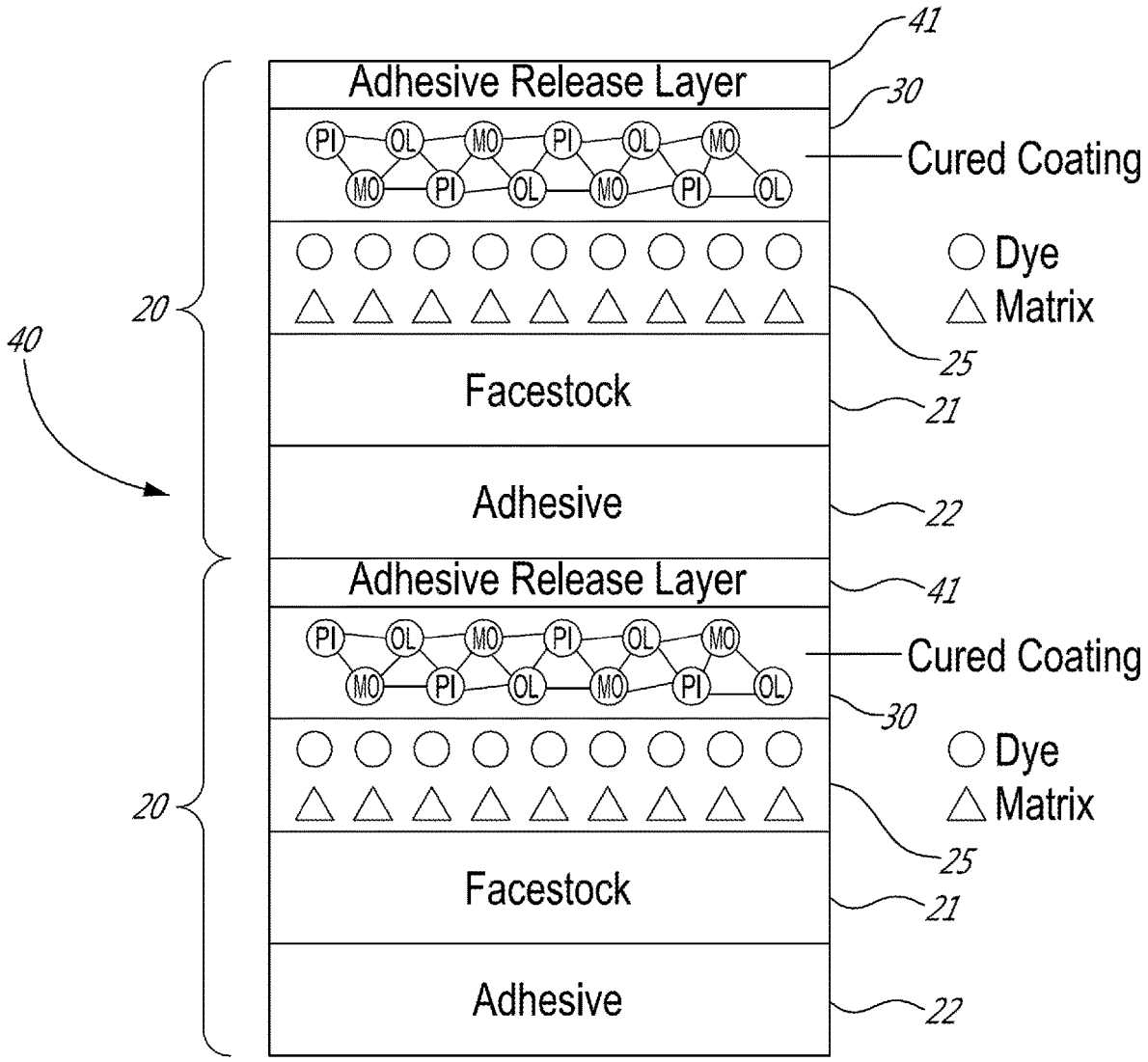
Figure 4C:
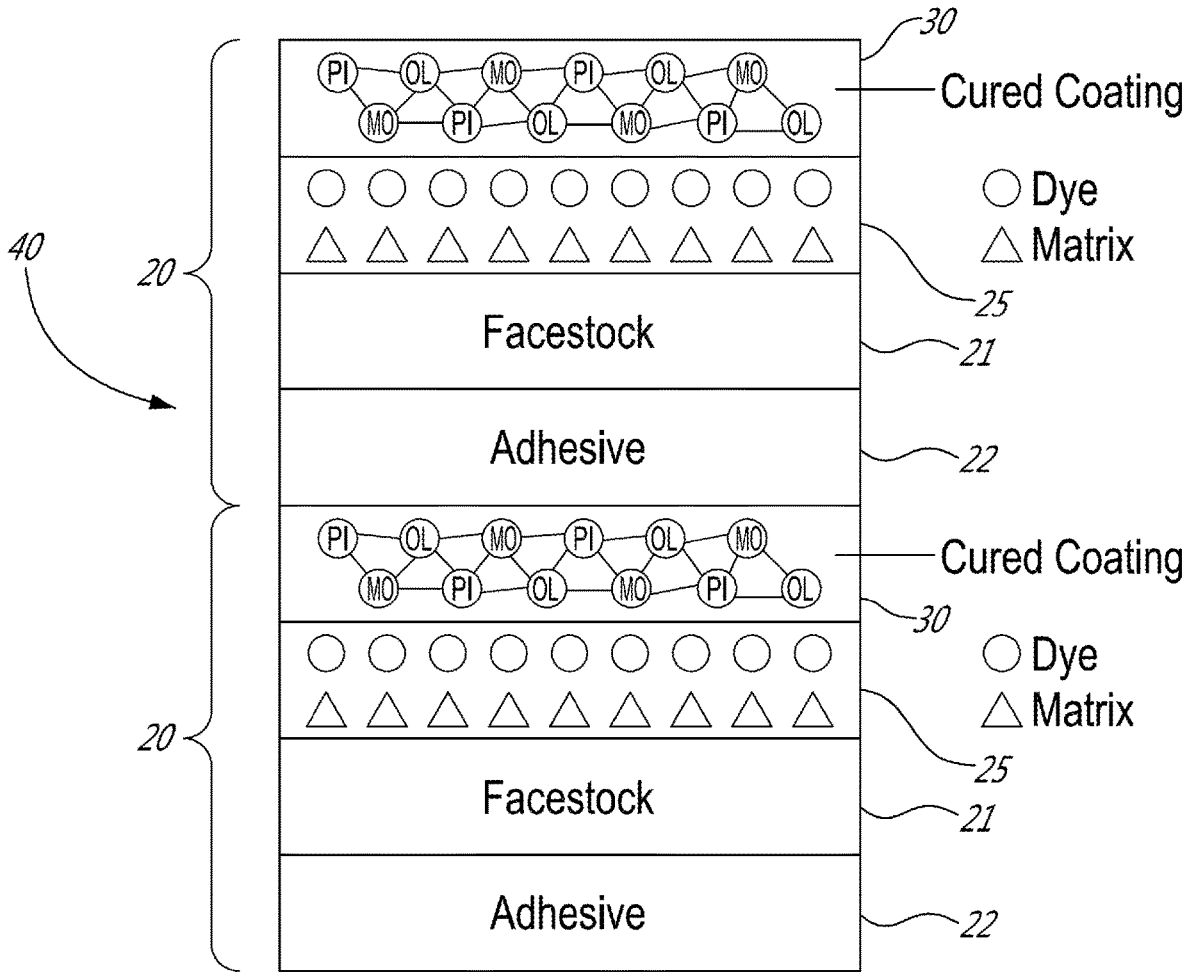
Figure 4D:
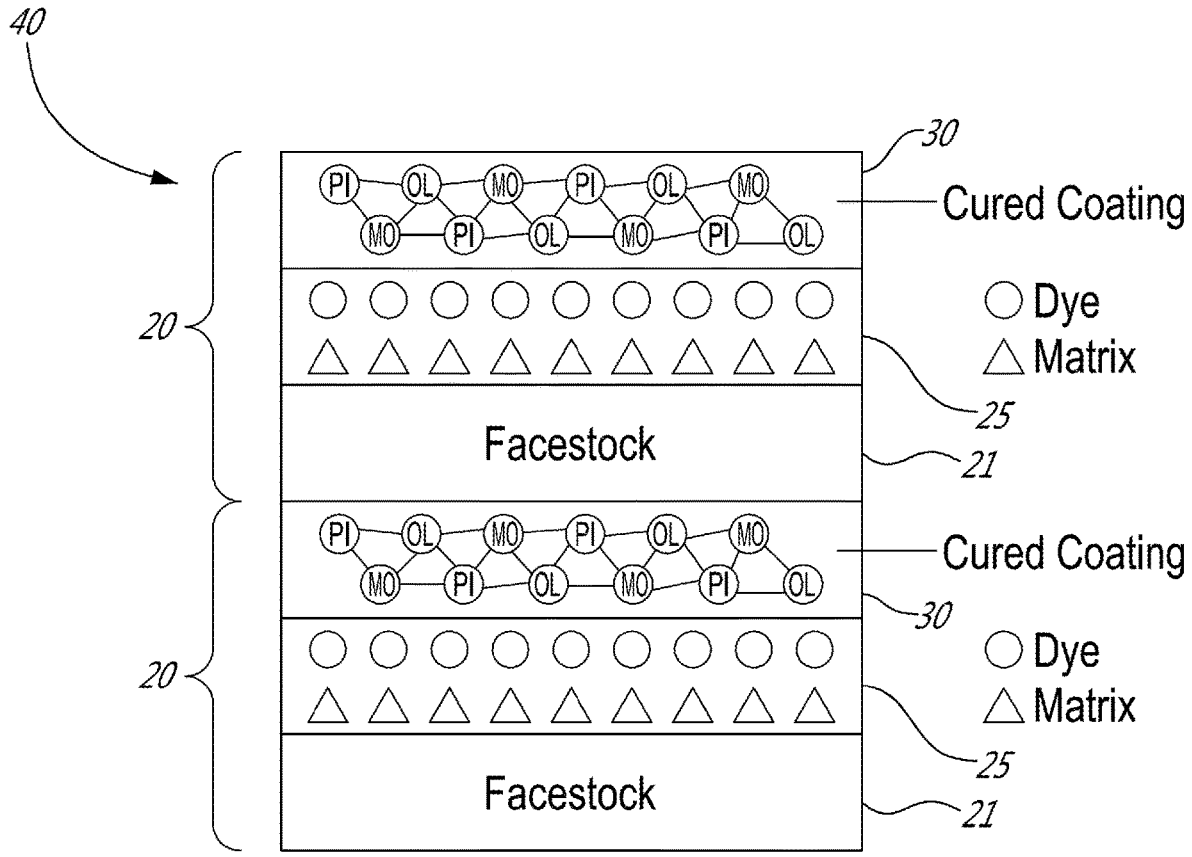

FIGS. 4A-4D shows different embodiments of the direct thermal label 20, for example when in a roll 40. When in a roll 40, the direct thermal label 20 is in an elongated strip that is wound on itself. Accordingly, in FIG. 4A there are shown two passes of the direct thermal label 20 on itself, but it is understood that there may be numerous other passes of the direct thermal label 20 on itself. In FIG. 4A, the direct thermal label 20 is as in FIG. 3A, with adhesive release layer 23 and support liner 24. In FIG. 4B, the adhesive release layer 23 and support liner 24 on the bottom of the adhesive layer 22 are absent. In such an embodiment, as the label 20 with direct thermal coating 25 is without a support liner 24, an adhesive release layer 41 may be laid on top of the LED UV coating 30. The adhesive release layer 41 is present to facilitate the release of the label 20 from itself, with the adhesive 22 from a top pass detaching from the adhesive release layer 41 from an under pass. The adhesive release layer 41 is selected so as not to interfere with the direct thermal printing. The adhesive release layer 41 may be a transparent coating comprising silicone or wax that can facilitate the release of the adhesive 22 while not interfering with the LED UV coating functions. The adhesive release layer 41 may be added after the LED UV layer is applied and cured. In FIG. 4C, the adhesive release layer 23 and support liner 24 on the bottom of the adhesive layer 22 are also absent, as the LED UV coating 30 described hereinafter serves as an adhesive release layer. In such an embodiment, the LED UV coating 30 may incorporate silicone or other compounds and additives facilitating a release of the adhesive 22 from the LED UV coating. In another configuration, shown in FIG. 4D, the adhesive layer 22, the adhesive release layer 23 and support liner 24 are absent. The facestock 21 of a top pass lays on the LED UV coating 30 of a lower pass, without adhesion therebetween.

Stated differently, other embodiments for the label 20 include a label and/or uncut label material without the adhesive release layer 23, a support liner 24 shared by numerous facestocks 21 and adhesive 22, or the label 20 without the support liner 24. The label 20 may have any appropriate shape, including round, square, rectangular, to name but a few of the possibilities. Moreover, a plurality of the labels 20 may be interconnected in a sheet, roll, etc., for example with tear-off perforations or cuts.

The label 20 has a direct thermal coating 25, with dye and matrix. For example, the direct thermal coating 25 includes a thermochromic ink and/or a thermochromic ink activation substance. The direct thermal coating 25 is heat sensitive as it reacts to heat to darken. Zones or surfaces are selectively heated to darken, these zones contrasting with the color of the facestock 21 and constituting the printing on the label 20. According to an embodiment, a thermochromic ink of the coating 25 is a leuco dye. These dyes have a colorless leuco form when crystalline in a pH neutral environment, and become colored when exposed to an acid. Examples of acids suitable for thermochromic materials are phenols, e.g., Bisphenol A (BPA) and Bisphenol S (BPS). Other suitable acidic substances can be used as developers for leuco dyes (sulfonyl ureas, zinc salts of substituted salicylic acids, etc.). To optimize the colorization temperature and to facilitate mixing, sensitizers can optionally be added to the direct thermal coating 25, such as 1,2-bis-(3-methylphenoxy)ethane or 2-benzyloxynapthalene. These ethers are solvents for leuco dyes and developers, and facilitate color formation at a specific temperature. To stabilize the color formed by the leuco dye, developer and sensitizer, a stabilizer might be added to the direct thermal coating 25 prior to application on the label 20. As a non-limitative example, stabilizers may be phenols that inhibit recrystallization of the dye and developer, thereby stabilizing the printed image. The above described technology is presented as an example, and not all constituents thereof are required to be present in the direct thermal coating 25 in order to achieve a thermal printing. For example, the direct thermal coating 25 might be activated without a sensitizer or stabilizer or both. Different types of thermochromic inks and developers can be used.

A LED UV coating 30 covers the direct thermal coating 25. As an example, the LED UV coating 30 may be a benzophenone-free transparent coating that forms a protective shield to protect the printing on the label 20 from solvents and chemicals. The LED UV coating 30 has photoinitiators. The photoinitiators are molecules that create reactive species when exposed to radiation. In the present disclosure, the LED UV coating 30 is selected to have photoinitiators with substantial activation in the wavelength range of around 365 nm to 450 nm. In another embodiment, or in the same embodiment, some other photoinitiators of the LED UV coating 30 can be activated in a wavelength range of 315-405 nm as well, within the ambit of the present disclosure. Accordingly, the LED UV coating 30 has the property of being curable with light-emitting diode (LED) generated waves due to the relatively short wavelength range. As a consequence, the LED UV coating 30 is curable while limiting the temperature of the surface of the substrate supporting the LED UV coating 30, for example to around 55° C. The substantial activation may be of at least 75%, and up to 90-95% of photoinitiators. Therefore, the curing is done without heat activating the direct thermal coating 25. As shown in FIG. 2C, the label 20 therefore has a LED UV coating 30 prior to being thermally printed. Basic constituents of a LED UV coating 30 are oligomers, prepolymers, monomers and photoinitiators for curing. A more efficient cure is possible with a formulation designed specifically for LED curing using a photoinitiator with more concentrated absorption in the UV-A range.

As a non-limitative example, the UV LED coating 30 described above was tested and its curing was attempted with ordinary mercury based UV curing system, in comparison to LED curing. In particular testing conditions, the mercury based curing showed a lower level of resistance to alcohol, around 1-2 minutes, compared to 60 minutes of resistance when a similar coating 30 was cured with a LED UV diode source. The mercury based UV light source creates a wider range of UV light and the specific wavelength necessary for activating the photoinitiators within the spectrum can only partially cure the LED UV coating 30. As a result, a significant portion of the LED UV coating 30 may not be properly cured with a mercury based UV curing system, resulting in less resistance to chemicals. Therefore, tests may indicate that the chemical resistance of the LED UV coating 30 may be dependent on the percentage of photoinitiator (PI) activations and as a result to the percentage of curing taking place during the UV radiation of the LED UV coating 30. The activation of the photoinitiators depends on a few factors, such as the moving speed of the label 20 or the material of the label 20 prior to die-cutting through the press, the distance of the light from the label 20, and how much exposure the UV LED coating 30 gets during the curing process. Under optimal conditions approximately 95% of the photoinitiators get activated in LED diode generated radiation resulting a strong protection of the ink underneath the UV LED coating 30.

Referring to FIG. 3A, the label 20 is shown in its ready-for-printing condition, i.e., with the cured LED UV coating 30 thereon. In FIG. 3A, the label 20 is blank meaning there has been no heat activation of the direct thermal coating 25. The facestock 21 and the direct thermal coating 25 are thus shielded by the LED UV coating 30. When print head A is applied to the label 20, it may heat the selected zones of the direct thermal coating 25 through the LED UV coating 30. The heat may be for example conducted through the LED UV coating 30 to the selected zones of the direct thermal coating 25. The LED UV coating 30 does not lose its shielding properties in spite of the heating with the direct thermal printer A.

Therefore, in accordance with an embodiment, the label 20 has a facestock 21 adapted to be adhered to an object. The object may be any type of object, such as objects used in laboratories, including vials, tubes, blood collection tubes such as Vacutainers, sample collection tubes, microscope slides, tissue processing cassettes, plates, cell culture plates, microtiter plates, microarray plates, other types of plates, petri dishes, bottles, flasks, freezer boxes, cryogenic boxes, cryogenic straws, goblets other type of laboratory plastic containers, laboratory glassware and metal objects such as freezer racks, liquid nitrogen racks, canisters, etc. Furthermore, other objects, containers and surfaces in other industries are covered by the present disclosure. A direct thermal coating 25 is on the facestock 21. The direct thermal coating 25 is configured to locally darken by heat activation when direct thermal printed. A cured ultraviolet coating 30 is on the direct thermal coating 25. The cured ultraviolet coating 30 has photoinitiators activated to at least 75% with exposure to a 365 nm-450 nm wavelength range, such as light produced by UV LEDs. The cured ultraviolet coating is configured to allow direct thermal printing of the direct thermal coating therethrough. The ultraviolet coating 30 is cured without creating heat sufficient to heat activating the direct thermal coating 25.

In accordance with another embodiment, a method is defined fabricating a direct thermal label 20. The ultraviolet coating 30 is applied on the direct thermal coating 25 on the facestock 21. The ultraviolet coating 30 is substantially cured by exposure to ultraviolet light-emitting diodes producing light in a wavelength range of 365 nm-450 nm. While substantially curing the ultraviolet coating, the direct thermal coating 25 is maintained below a threshold temperature above which the direct thermal coating 25 is activated.

In accordance with another embodiment, a method for using a direct thermal label is provided. The label 20 is obtained with the direct thermal coating 25 shielded by the cured ultraviolet coating 30. Selected zones of the direct thermal coating 25 are heat activated through the ultraviolet coating 30 to darken the selected zones. The label 20 is adhered with the selected zones darkened to an object.

The invention claimed is:

1. A label comprising:

a facestock adapted to be adhered or attached to an object;

a direct thermal coating on the facestock, the direct thermal coating configured to selectively darken by heat activation when direct thermal printed; and a cured ultraviolet coating on the direct thermal coating, the cured ultraviolet coating having photoinitiators with substantial activation at an exposure limited to radiation at a 365 nm-450 nm wavelength range, and configured to allow direct thermal printing of the direct thermal coating therethrough, wherein the cured ultraviolet coating is cured without heat activating the direct thermal coating.

2. The label according to claim 1, wherein the cured ultraviolet coating is a benzophenone-free transparent coating.

3. The label according to claim 1, wherein the direct thermal coating includes a thermochromic ink and/or a thermochromic ink activation substance.

4. The label according to claim 3, wherein the thermochromic ink is a leuco dye.

5. The label according to claim 4, further including a stabilizer in the direct thermal coating to inhibit recrystallization of the leuco dye.

6. The label according to claim 5, wherein the stabilizer is a phenol.

7. The label according to claim 4, further including a sensitizer in the direct thermal coating to optimize the colorization temperature and to facilitate mixing.

8. The label according to claim 7, wherein the sensitizer is 1,2-bis-(3-methylphenoxy)ethane or 2-benzyloxynapthalene.

9. The label according to claim 4, wherein the direct thermal coating includes Bisphenol A (BPA), Bisphenol S (BPS), sulfonyl ureas, and/or zinc salts of substituted salicylic acids.

10. The label according to claim 1, wherein the facestock has a thickness between 0.5 mil-10 mil, inclusively.

11. The label according to claim 1, wherein the facestock is made of a fiber-based material, a polymer, a synthetic film, a thermoplastic film, polyolefin, polypropylene, biaxially oriented polypropylene (BOPP), polyester, polyvinyl, polyethylene, or polystyrene.

12. The label according to claim 1, wherein the cured ultraviolet coating includes a compound facilitating a release of an adhesive on the cured ultraviolet coating.

13. The label according to claim 1, further comprising an adhesive layer on an underside of the facestock.

14. The label according to claim 13, further comprising a support liner upon which the adhesive layer is releasably adhered.

15. The label according to claim 14, further comprising an adhesive release layer between the adhesive layer and the support liner.

16. The label according to claim 13, wherein the label is arranged in a roll, with the adhesive layer of a first roll pass glued to the cured ultraviolet coating of a second roll pass.

17. The label according to claim 1, wherein the radiation at the 365 nm-450 nm wavelength range is created by a LED lamp.

18. The label according to claim 1, wherein the cured ultraviolet coating is a solvent-resistant coating.

19. The label according to claim 1, wherein the cured ultraviolet coating has the substantial activation of at least 75% of the photoinitiators.

20. A label comprising:

a facestock adapted to be adhered or attached to an object;

a direct thermal coating on the facestock, the direct thermal coating configured to selectively darken by heat activation when direct thermal printed; and a cured ultraviolet coating on the direct thermal coating, the cured ultraviolet coating having photoinitiators with substantial activation at an exposure limited to radiation at a 315 nm-450 nm wavelength range, and configured to allow direct thermal printing of the direct thermal coating therethrough, wherein the cured ultraviolet coating is cured without heat activating the direct thermal coating, the cured ultraviolet coating has the substantial activation of at least 75% of the photoinitiators.

* * * * *